US005355752A

United States Patent [19]

Keenan et al.

[11] Patent Number: 5,355,752

[45] Date of Patent: Oct. 18, 1994

[54] SCREWHOLDER FOR SCREWDRIVER

[75] Inventors: Christopher S. Keenan, Colorado Springs; Joseph N. Varnell, III, Black Forest, both of Colo.

[73] Assignee: Emerson Electric Co., St. Louis, Mo.

[21] Appl. No.: 194,911

[22] Filed: Feb. 14, 1994

[51] Int. Cl.[5] ..... B25B 23/10

[52] U.S. Cl. ..... 81/453; 81/455

[58] Field of Search ..... 81/451–458

[56] References Cited

U.S. PATENT DOCUMENTS 1,770,182 7/1930 Ritter ..... 81/453

4,763,548 8/1988 Leibinger et al. ..... 81/453

*Primary Examiner*—D. S. Meislin

*Attorney, Agent, or Firm*—Polster, Lieder, Woodruff & Lucchesi

[57] ABSTRACT

A screwholder adapted to be mounted over a screwdriver shank that includes an outwardly flared blade section adjacent a screwdriver tip is disclosed. The screwholder includes a hollow extension tube that mounts over the screwdriver shank. One end of the hollow extension tube has an enlarged section for engagement and displacement along the screwdriver shank by the thumb of a user. The other end of the hollow extension tube includes screw gripping fingers for gripping a screw. The screw gripping fingers extend upwardly from the hollow extension tube and are captured between an inner retaining plate and an outer housing. The screw gripping fingers further have outer free ends for gripping opposed areas of a screw. A compressible spring is positioned within the outer housing between the inner retaining plate and the hollow extension tube. The inner retaining plate includes a restricted opening for engaging the outwardly flared blade section of the screwdriver which causes compression of the compressible spring to enable the outer free ends of the screw gripping fingers to be moved apart for release or gripping of opposite areas of a screw.

10 Claims, 4 Drawing Sheets

SCREWHOLDER FOR SCREWDRIVER

BACKGROUND OF THE INVENTION

The present invention relates to a screwholder for a screwdriver, and more particularly, to a low cost and reliable screwholder for a screwdriver.

As screwdrivers have been developed over the years, efforts have also been underway in developing various types of devices for holding a screw in cooperating engagement with the screw engaging/driving or tip end of a screwdriver. For example, in the early 1900's, several types of screwholders for screwdrivers were developed as represented by U.S. Pat. Nos. 864,633 (1907); 951,526 (1910); and 1,212,743 (1917). Each of these patents disclose spring urged gripping fingers where an exposed coil spring surrounds a screwdriver shank and functions to urge a pair of screw gripping fingers into gripping engagement with a screw adjacent the screw engaging/driving or tip end of a screwdriver. There are other examples in the prior art where an outer housing protectively surrounds a coil spring operating to urge screw gripping fingers of a screwholder into gripping engagement with the screw. Examples of such screwholder devices include U.S. Pat. No. 1,641,307 which employs a hexagonally shaped enclosed outer housing and U.S. Pat. No. 2,633,168 where a cylindrically shaped enclosed outer housing as disclosed. At the same time, it has been found desirable to provide a thumb disk or shoulder adjacent the screwdriver handle to operate the screwholder device. Examples of thumb disk/shoulder operative screwholder devices are shown, for example, in U.S. Pat. Nos. 2,762,408 and 2,933,114.

While each of the aforementioned and other prior art screwholder devices provide some of the features desirable in a preferred screwholder device, it is apparent that such prior art devices have not fully met market demands. In this connection, it has been determined from market studies that a screwholder with the following functional and structural features would be most desirable:

1. Single handed screwholder operation.
2. Thumb operation of the screwholder device.
3. Expanding/retracting screw gripping fingers associated with the screwholder.
4. Reduced screwholder components using standard parts where possible.
5. Improved manufacturability and assembly of screwholders.
6. Improved screwholder reliability during repeated use.

The screwholder device of the present invention has been developed with the foregoing design criteria in mind, as will become apparent from the description that follows.

SUMMARY OF THE INVENTION

Among the several objects and advantages of the present invention include a new and improved screwholder for screwdrivers which overcomes many of the problems associated with the prior art including cost, complexity, number of parts and difficulty/cost of manufacture/assembly;

The provision of the aforementioned new and improved screwholder which meets all of the aforementioned design criteria including single handed screwholder operation, thumb operation of the screwholder device, expanding and retracting screw gripping fingers, reduced component parts using standard parts where possible, improved manufacture ability and assembly and improved product reliability during repeated use;

The provision of the aforementioned new and improved screwholder device which also is: easy to manufacture and use, is low in cost to the manufacture with consequent savings to the distributor and consumer, and is otherwise well adapted for the purposes intended.

Briefly stated, the screwholder device of the present invention is adapted to be mounted over a screwdriver shank that includes an outwardly flared blade section adjacent a screwdriver tip. The screwholder includes a hollow extension tube for mounting over the screwdriver shank, the hollow extension tube having an enlarged section at one end for engagement and displacement along the screwdriver shank by the thumb of a user and screw gripping fingers attached to an opposite end for gripping a screw. The screw gripping fingers extend upwardly from the hollow extension tube and are captured between an inner retaining plate that is secured to an outer housing at an upper end, the screw gripping fingers further having outer free ends for gripping opposite areas of a screw. A compressible spring is positioned within the outer housing and extends between the inner retaining plate at one end of the outer housing and the opposite end of the hollow extension tube positioned within a lower end of the outer housing. The inner retaining plate includes restricted opening for engaging the outwardly flared blade section of the screwdriver to restrict disassembly of the screwholder relative to the screwdriver, such that engagement of the enlarged section and movement of the hollow extension tube toward the screwdriver tip causes binding engagement of the restricted opening of the inner retaining plate with the outwardly flared blade section for compression of the compressible spring to enable the outer free ends of the screw gripping fingers to be moved apart for release or gripping of opposite areas of a screw.

The outer housing has a hexagonal configuration and is constructed to surround the compressible spring. The inner retaining plate also has a hexagonal configuration corresponding to the hexagonal configuration of the outer housing.

The screw gripping fingers comprise an opposed pair of screw gripping fingers that are trapped between oppositely positioned hexagonal surfaces of the inner retaining plate and the outer housing. Part of the screw engaging fingers are trapped between the outer housing and the compressible spring. The compressible spring is preferably a coil spring. A recess is formed in the outer ends of the screw gripping fingers for complementary mounting over a Phillips head type screwdriver and to assist in gripping a screw.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way of limitation. This description will clearly enable one skilled in the art to make and use the invention and describes several embodiments, adaptions, variations, alternatives and uses of the screwholder for screwdrivers as disclosed, including what I presently believe is the best mode of carrying out the invention.

Figure 1:
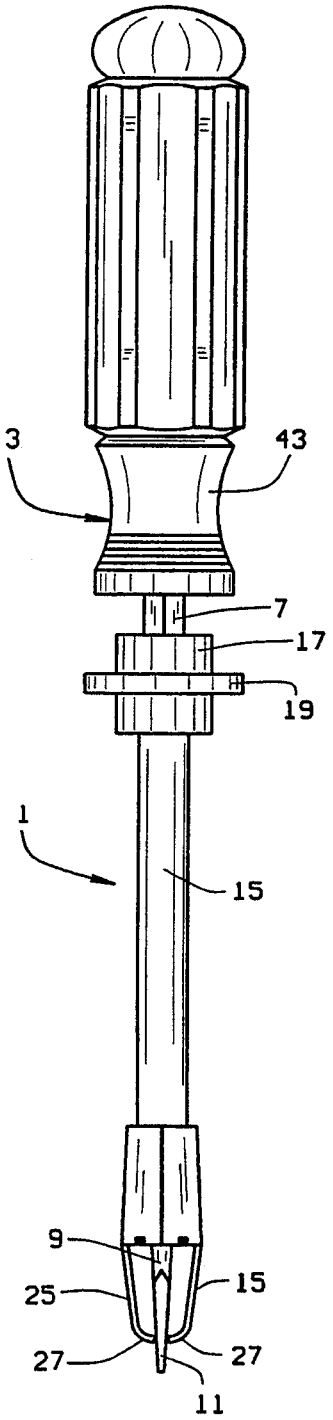
FIG. 1 is a side elevational view of the new and improved screwholder device for screwdrivers which is constructed in accordance with the teachings of the present invention.
Figure 2:
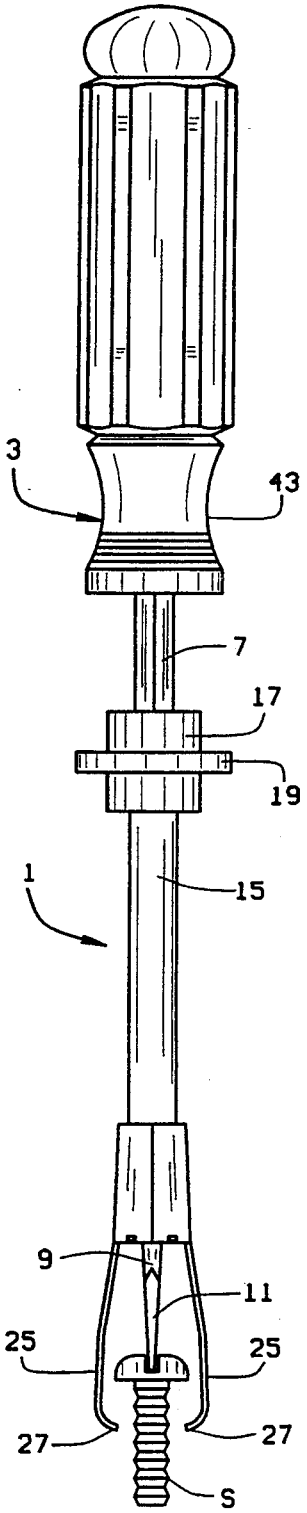
FIG. 2 is a side elevational view of the new and improved screwholder device illustrating the manner in which associated screw gripping fingers are designed to be expanded/released relative to an associated screw.
Figure 3:
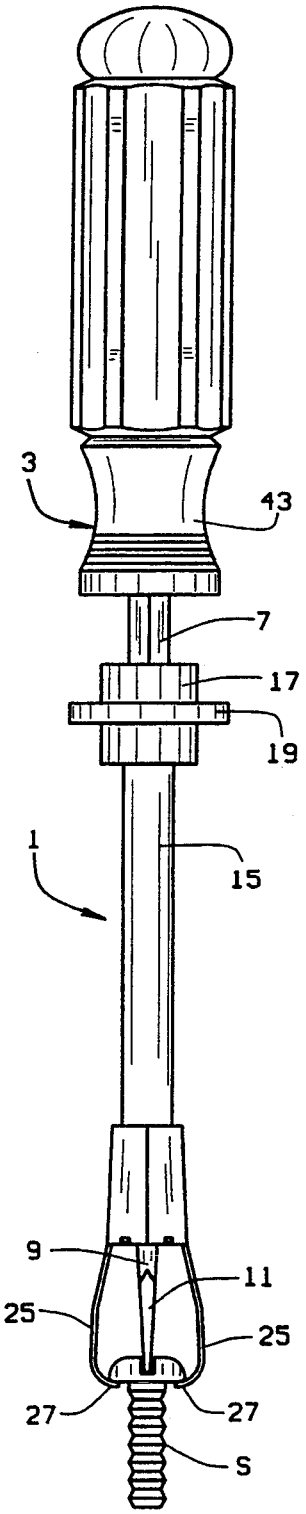
FIG. 3 is also a side elevational view of the new and improved screwholder device illustrating the manner in which the associated screw gripping fingers of the screwholder device grips an associated screw in conjunction with the blade tip of the screwdriver on which the screwholder device is mounted.
Figure 7:
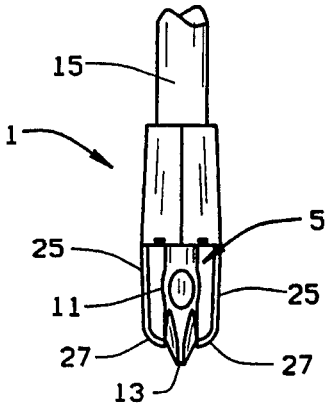
FIG. 7 is a fragmentary side elevational view illustrating the screwholder device mounted over a Phillips head type screwdriver.
Figure 8:
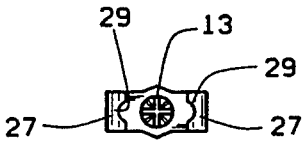
FIG. 8 is an end elevational view of the screwholder device mounted over a Phillips head screwdriver as shown in FIG. 7.

As illustrated in the drawings, the screwholder 1 is adapted to be mounted over a screwdriver 3 of the flat blade type as shown in FIGS. 1–3 or the Phillips head type of screwdriver 5 illustrated in FIGS. 7–8 of the drawings. In either case, the screwholder 1 is adapted to be mounted over a screwdriver shank 7 that includes an outwardly flared blade section 9 adjacent a flat screwdriver tip 11 as shown in FIG. 1–3 or a Phillips head screwdriver tip 13 as shown in FIGS. 7–8 of the drawings. As will become apparent, the screwholder 1 includes components which cause binding engagement with the flared blade section 9 for operative movement of the screwholder 1 presently to be described.

The screwholder 1 includes a hollow extension tube 15 for mounting over the screwdriver shank 7. An enlarged cylinder section 17 with integral thumb disk 19 is secured to the lower end 21 (see FIG. 6) of the hollow extension tube 15. The thumb disk 19 is engaged by the thumb of a user for displacing the hollow extension tube 15 along the screwdriver shank for operative engagement and disengagement of the screwholder relative to an associated screw.

Figure 5:
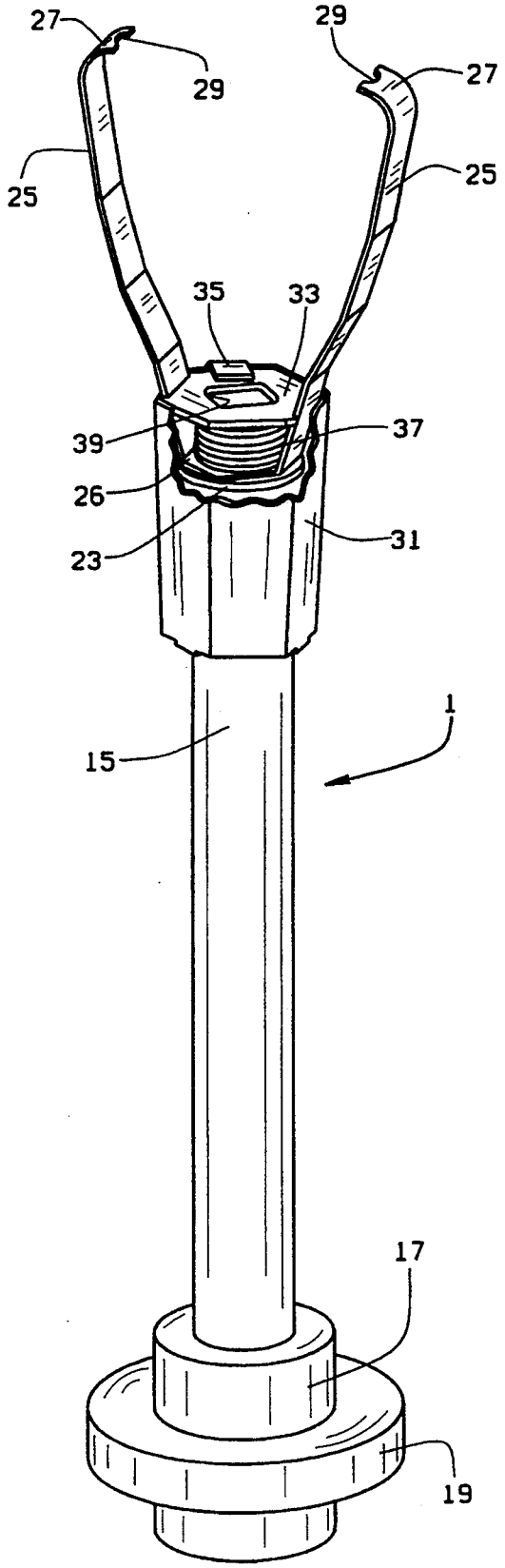
FIG. 5 is also an enlarged fragmentary perspective view of the screwholder device illustrating the screw gripping fingers in expanded or open position.
Figure 6:
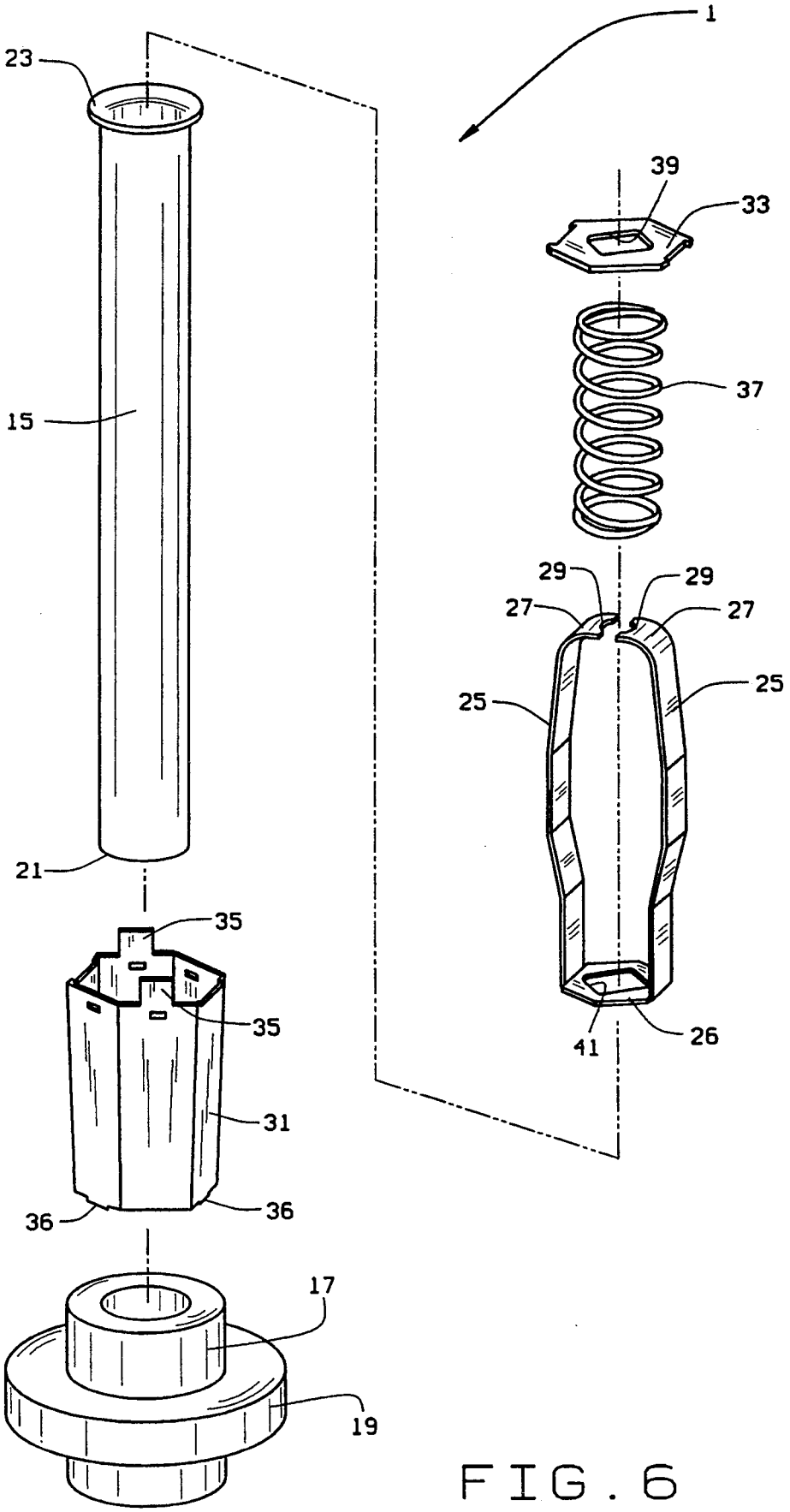
FIG. 6 is an exploded perspective view illustrating the various components constituting the screwholder device shown in FIGS. 1–5 of the drawings.

At the opposite end 23 of the hollow extension tube 15, a pair of screw gripping fingers 25, 25 are secured through the integral bite end portion 26, as shown in FIG. 6. The integral bite end portion 26 of the screw gripping fingers 25, 25 may be secured to the enlarged upper end 23 of the hollow extension tube 15 or abut against the upper end 23 of the hollow extension tube 15, as may be desired. In either case, the integral bite end portion 26 abuts against the enlarged upper end 23 of the hollow extension tube 15, as best shown in FIGS. 4–5 of the drawings.

The screw gripping fingers 25, 25 extend upwardly from the hollow extension tube and terminate in inwardly curved outer ends 27, 27 which function to grip or otherwise engage an associated screw S, as will be apparent. Each of the inwardly curved outer ends 27, 27 of the screw gripping fingers 25, 25 include a recess 29 for complementary mounting over a Phillips head type screw driver blade tip 13, as shown in FIGS. 7–8 and/or to assist in gripping an associated screw S as shown, for example, as shown in FIG. 3 of the drawings.

Figure 4:
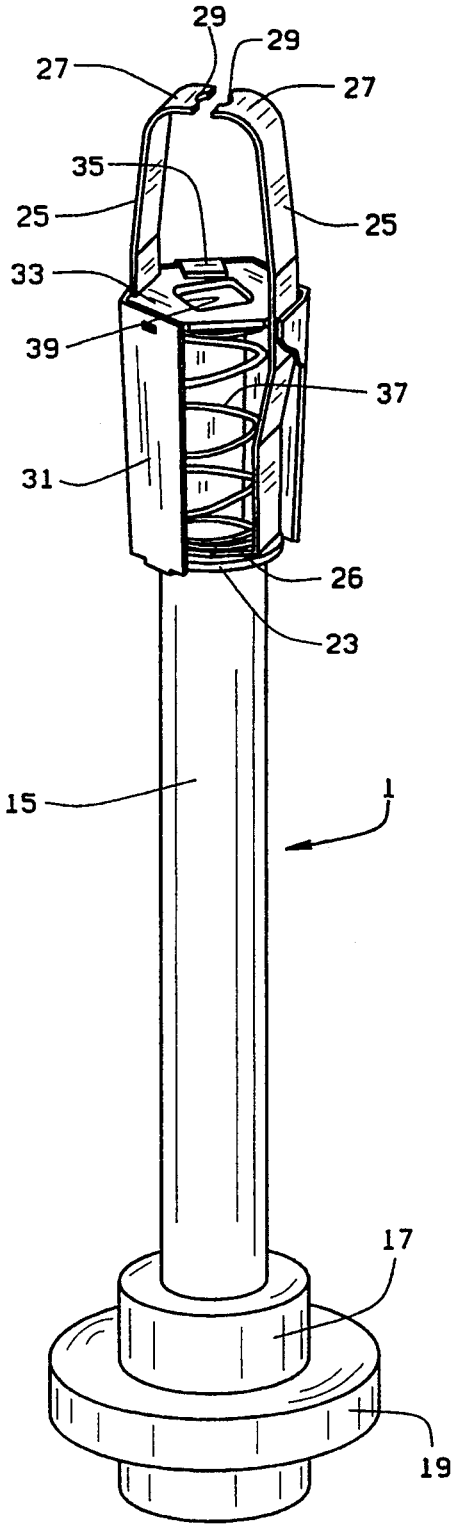
FIG. 4 is an enlarged fragmentary perspective view of the screwholder device illustrating the various components thereof with the screw gripping fingers in a collapsed or retracted position.

An outer housing 31 surrounds approximately the lower half of each of the screw gripping fingers 25, 25, as best seen in FIG. 4 of the drawings. The outer housing also has a hexagonal shape for operative engagement with other components of the screwholder 1, as will become apparent.

As best seen in FIGS. 4–5 of the drawings, the lower half portion of the screw gripping fingers 25, 25 are captured between a hexagonally shaped inner retaining plate 33 and the hexagonally shaped outer housing 31. Specifically, the flat rectangular-shaped end cross section screw gripping fingers 25, 25 are trapped between oppositely positioned hexagonal edge surfaces of the inner retaining plate 33 and hexagonal side surfaces of the hexagonal outer housing 31. The outer housing 31 has a pair of upper spaced end tabs 35, 35 which are bent over the inner retaining plate 33 for securing same to the outer housing 31. The outer housing 31 also includes lower spaced end tabs 36, 36 which are bent under the enlarged upper end 23 for securing the outer housing 31 relative to the hollow extension tube 15.

A compressible spring 37 is positioned within the outer housing 31 and extends between the inner retaining plate 33 at the upper end of the housing 31 and the integral bite end portion 27 of the screw gripping fingers 25, 25 at a lower end of the outer housing 31. In normal uncompressed condition as shown in FIG. 4 of the drawings, the compressible coil spring 37 maintains the screw gripping fingers 25 in a closed or retracted position, as illustrated. However, when the compressible spring 37 is compressed, as a result of the movement of the hollow extension tube 15 relative to the outer housing 31 as shown in FIG. 5 of the drawings, the screw gripping fingers 25, 25 are moved to an open or extended position, as illustrated.

The inner retaining plate 33 has a restricted opening 39 that cooperates with the outwardly flared blade section 9 of the screwdriver shank 7 to restrict disassembly of the screwholder 1 relative to the screwdriver 3 or 5. In this regard, during assembly of the screwholder 1 relative to a screwdriver, the screwdriver shank 7 is first inserted into the restricted opening 39 of the inner retaining plate 33 and then through the corresponding restricted opening 41 in the inner bite portion 26 of the screw gripping finger 25, 25 for assembly of the screwdriver shank 7 relative to the screwholder 1, prior to the assembly of the screwdriver shank 7 to the screwdriver handle 43. Thus, the screwholder 1 is trapped between the screwdriver handle 43 and the outer flared blade section 9 of the screwdriver shank 7 as a result of the binding engagement of the restricted opening 39 in the inner retaining plate 33 with the outwardly flared blade section 9 of the screwdriver shank.

Due to the aforesaid construction of the screwholder 1 relative to an associated flat blade screwdriver 3 or Phillips head screwdriver 5, the operation of the screwholder 1 will be readily understood. More particularly, when the user desires to operate the screwholder 1 for gripping an associated screw S, the user grips the handle 43 of a screwdriver while placing the user's thumb against the thumb disk 19 for axially moving the hollow extension tube 15 along the longitudinal length of the screwdriver shank 7. This is represented by the axial displacement of the screwholder from the FIG. 1 to the FIG. 2 position. As a result of this axial movement, the coil spring 37 within the outer housing 31 becomes compressed, as illustrated in FIG. 5 of the drawing, causing the screw gripping fingers 25, 25 to be moved to their open or expanded position, as shown in FIG. 2 of the drawings. In this condition, the user can position an associated screw S relative to the flat blade tip 11, and then by releasing the thumb disk 19, the user can allow the hollow extension tube 15 to be moved by the compressible coil spring 37 back to the position illustrated in FIG. 3 of the drawings where the associated screw S is engaged by the inwardly curved outer free ends 27, 27 of the screw gripping fingers 25, 25. The user can now quickly and easily thread or drive the associated screw S relative to its complementary female threaded component, as will be appreciated.

The recess 29 formed in the edges of the inwardly curved outer free ends 27 of each of the screw gripping fingers 25, 25 provides a flexible and aggressively impinging edge surface for contact with the head of an associated screw as shown in FIG. 3 of the drawings or with a screw shank (not shown) for certain screw sizes.

The screwholder 1 thus provides an easy to operate, secure and reliable screw engaging function, as described, while utilizing a minimum number of standard components in an easy to manufacture and assembled construction.

Figure 9:
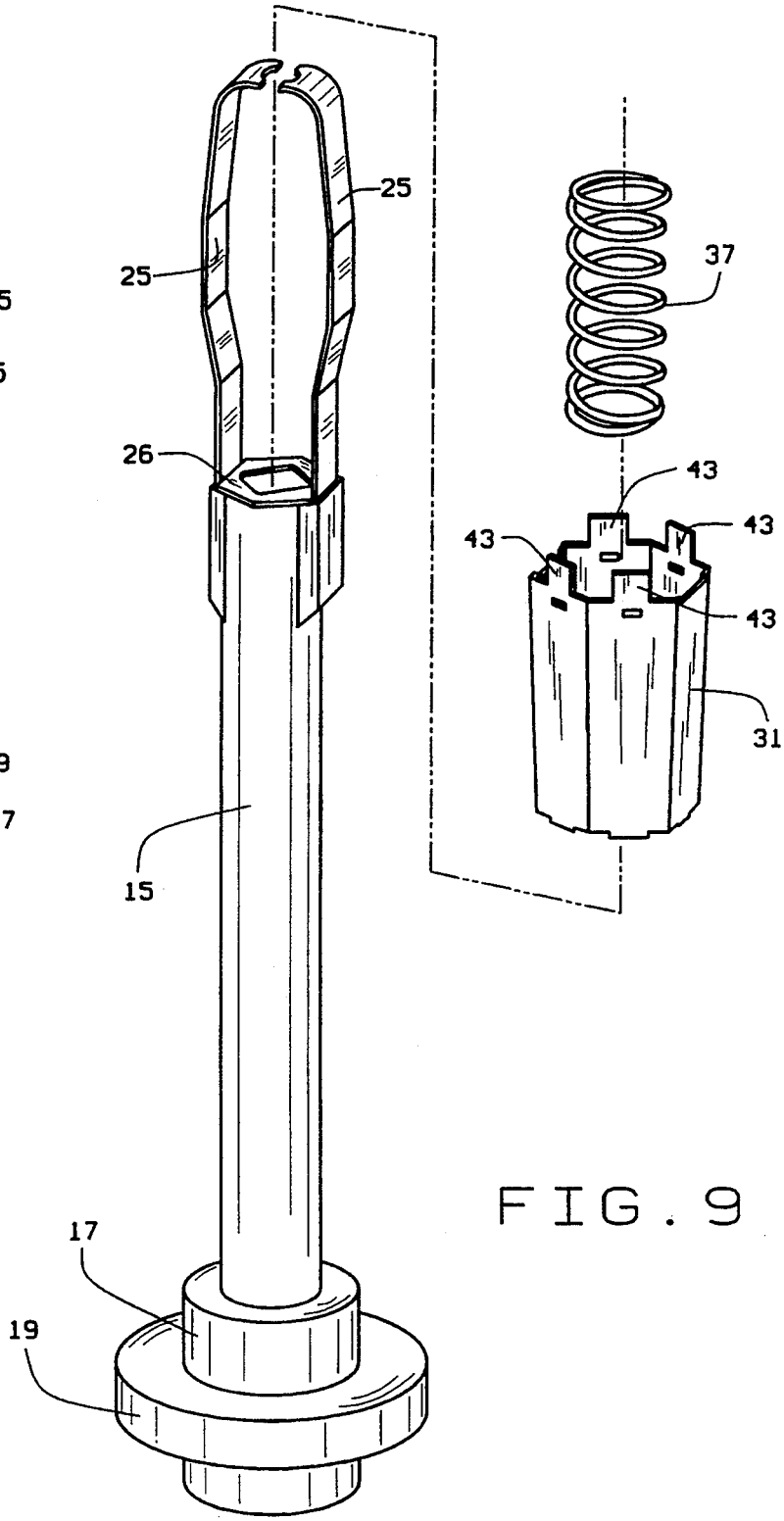
FIG. 9 is an exploded perspective view illustrating a modified form of screwholder for screwdrivers which is constructed in accordance with the teachings of the present invention.

It is quite apparent that a variety of different changes and modifications can be made within the purview of the present invention. For example, in FIG. 9 of the drawings, the outer housing 31 is shown as being provided with four peripherally spaced tabs 43 which are designed to replace the inner retaining plate 33 when bent over to extend in a substantial normal direction to the hexagonal side surfaces of the outer housing 31, for trapping the compressible coil spring 37 within the outer housing 31. This obviously will reduce the number of parts even further, if such is desired. Other similar modifications are possible.

From the foregoing, it will now be appreciated that the screwholder for screwdrivers of the present invention has achieved the several objects and advantages previously described as well as other advantageous results.

As various changes could be made in the above constructions without departing from the scope of the invention, it is intended that all matter contained in the above description or shown in the accompanying drawings shall be interpreted as illustrative and not in a limiting sense.

We claim:

1. A screwholder adapted to be mounted over a screwdriver shank that includes an outwardly flared blade section adjacent a screwdriver tip, the screwholder comprising:

a hollow extension tube for mounting over the screwdriver shank, said hollow extension tube having an enlarged section at one end for engagement and displacement along the screwdriver shank by the thumb of a user and screw gripping fingers attached to an opposite end for gripping a screw;

said screw gripping fingers extending upwardly from the hollow extension tube, an inner retaining plate that is secured to an outer housing at an upper end, thereof said outer housing being slidably mounted to said extension tube said screw gripping fingers being captured between said inner retaining plate and said outer housing and further having outer free ends for gripping opposite areas of a screw;

a compressible spring positioned within said outer housing and extending between the inner retaining plate at one end of the outer housing and the opposite end of the hollow extension tube which is positioned within a lower end of the outer housing; and said inner retaining plate having a restricted opening for engaging the outwardly flared blade section of the screwdriver to restrict disassembly of the screwholder relative to the screwdriver, whereby engagement of the enlarged section and movement of the hollow extension tube toward the screwdriver tip causes binding engagement of the restricted opening of the inner retaining plate with the outwardly flared blade section for compression of the compressible spring to enable the outer free ends of the screw gripping fingers to be moved apart for release or gripping of opposite areas of a screw.

2. The screwholder as defined in claim 1 wherein the outer housing surrounds the compressible spring.

3. The screwholder as defined in claim 1 wherein the inner retaining plate has a hexagonal configuration corresponding to a hexagonal configuration of the outer housing.

4. The screwholder as defined in claim 3 wherein the screw gripping fingers comprise an opposed pair of screw gripping fingers that are trapped between oppositely positioned hexagonal surfaces of said inner retaining plate and said outer housing.

5. The screwholder as defined in claim 4 wherein part of said screw engaging fingers are trapped between said outer housing and said compressible spring.

6. The screwholder as defined in claim 5 wherein the compressible spring is a coil spring.

7. The screwholder as defined in claim 6 and including a recess formed in the outer ends of the screw gripping fingers for complementary mounting over a Phillips head type screwdriver and to assist in gripping a screw.

8. A screwholder adapted to be mounted over a screwdriver shank that includes an outwardly flared blade section adjacent a screwdriver tip, the screwholder comprising:

a hollow extension tube for mounting over the screwdriver shank, said hollow extension tube having an enlarged section at one end for engagement and displacement along the screwdriver shank by the thumb of a user and screw gripping fingers attached to an opposite end of the hollow extension tube for gripping a screw;

said screw gripping fingers being positioned between spaced inner retaining elements on an outer housing at an upper end of said outer housing, said outer housing being slidably mounted to said extension tube said screw gripping fingers having outer free ends for gripping opposite areas of a screw;

a compressible spring positioned within said outer housing and extending between said inner retaining elements at an upper end of the other housing and the opposite end of the hollow extension tube which is positioned within a lower end of the outer housing; and said inner retaining elements being constructed for engaging the outwardly flared blade section of the screwdriver to restrict disassembly of the screwholder relative to the screwdriver, whereby engagement of the enlarged section and movement of the hollow extension tube toward the screwdriver tip causes binding engagement of the inner retaining elements with the outwardly flared blade section of the screwdriver for compression of the compressible spring to enable the outer free ends of the screw gripping fingers to be moved apart for release or gripping of opposite areas of a screw.

9. The screwholder as defined in claim 8 wherein the outer housing is hexagonally shaped and the integrally associated inner retaining elements extend inwardly from at least opposed sections of the hexagonally shaped outer housing.

10. The screwholder as defined in claim 9 wherein the screw engaging fingers are trapped between the outer housing and the compressible spring.

* * * * *